US005672321A

United States Patent [19]

Daykin

[11] Patent Number: 5,672,321

[45] Date of Patent: Sep. 30, 1997

[54] BIOLOGICAL SPECIMEN COLLECTION SYSTEM

[75] Inventor: Victor Daykin, Ajax, Canada

[73] Assignee: Samco Scientific, Inc., San Fernando, Calif.

[21] Appl. No.: 646,771

[22] Filed: May 8, 1996

Related U.S. Application Data

[63] Continuation of Ser. No. 230,923, Apr. 21, 1994, abandoned.

[51] Int. Cl.[6] ..... B01L 3/00; B65D 41/00

[52] U.S. Cl. ..... 422/102; 422/104; 215/354; 215/252

[58] Field of Search ..... 422/102, 104, 422/99; 73/863.11, 863.12; 210/787, 175; 436/296, 300; 215/354, 252

[56] References Cited

U.S. PATENT DOCUMENTS

| | | | |
|---|---|---|---|
| 3,741,424 | 6/1973 | Landen | 215/43 |
| 4,094,641 | 6/1978 | Friswell | 422/102 X |
| 4,206,852 | 6/1980 | Dunn et al. | 215/252 |
| 4,546,085 | 10/1985 | Johansson et al. | 435/284 |
| 4,546,086 | 10/1985 | Johansson et al. | 435/284 |
| 5,167,929 | 12/1992 | Kort et al. | 422/102 |
| 5,254,314 | 10/1993 | Yu et al. | 422/102 |
| 5,288,466 | 2/1994 | Burns | 422/102 |

FOREIGN PATENT DOCUMENTS 2030609 10/1993 Canada .

*Primary Examiner*—Harold Y. Pyon
*Attorney, Agent, or Firm*—Thomas R. Beall

[57] ABSTRACT

The present invention provides for a biological specimen collecting system for holding a biological specimen in a long term sustained sealed environment. The biological specimen collecting system includes a container for holding the biological specimen and a sealing closure cap. The container is of circular section and has generally vertical sidewalls, the sidewalls at the top terminating in an inwardly sloping sealing surface. The container has a first thread on an exterior surface thereof, the first thread being located below the sealing surface. The sealing closure cap has a peripheral groove to receive the container rim, the peripheral groove being defined by inner and outer walls and a top. The outer wall of the groove is provided with a second thread complementary to the first thread on the container for engagement therewith. The inner wall of the groove is provided with a sealing bead positioned above the second thread, the sealing bead contacting the sealing surface of the container to provide long term sustained sealing of the container by the sealing cap.

1 Claim, 3 Drawing Sheets

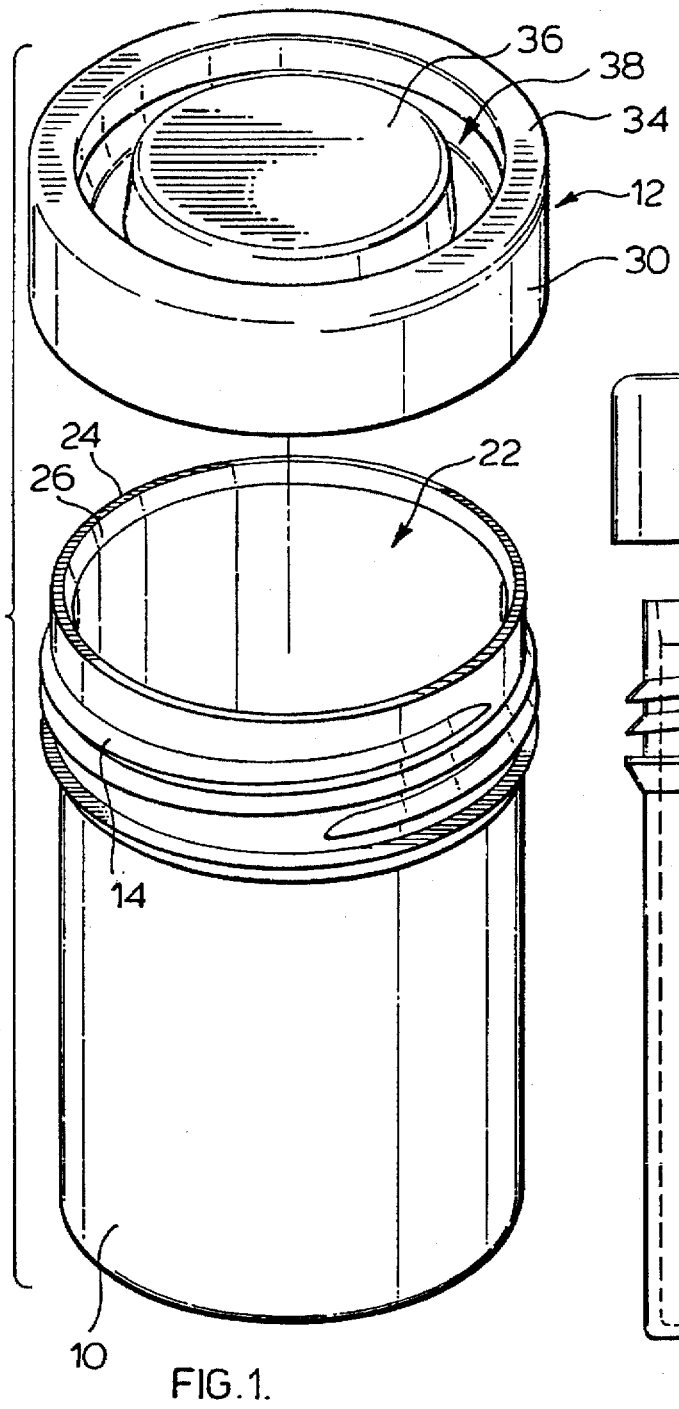
FIG.1.
FIG.2.
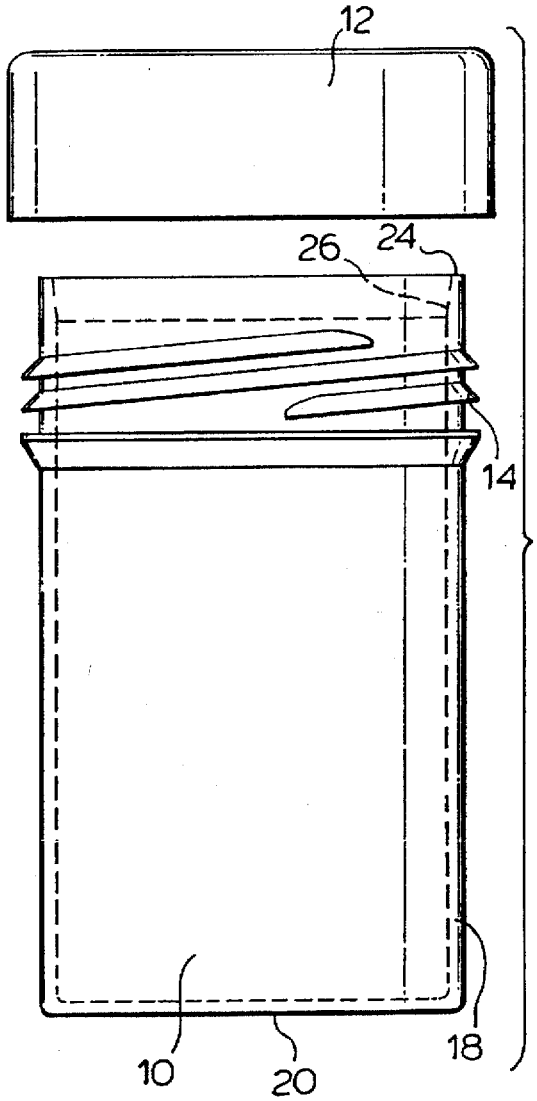

BIOLOGICAL SPECIMEN COLLECTION SYSTEM

This application is a continuation of application Ser. No. 08/230,923, filed Apr. 21, 1994, now abandoned.

FIELD OF THE INVENTION

The present invention relates to a biological specimen collection system including a sealing closure cap and a biological specimen collection container. In particular the invention relates to the combination of a sealing closure cap and a biological specimen container with reduced susceptibility to leakage.

BACKGROUND OF THE INVENTION

The safe handling of biological specimens has become increasingly critical in view of the increase in both the number and severity of potential hazards associated with the handling of such specimens. The onset of acquired immunodeficiency (AIDS) arising from infection by the highly contagious HIV virus has resulted in the increased awareness of the need for safe handling of biological specimens. This factor, along with such factors as potential infection from hepatitis virus and the increased awareness of the carcinogenic properties of substances in common medical use has created a demand for biological specimen containers that are of reasonable cost not susceptible to breakage or leakage, readily sealed and unsealed and suitable for disposal by incineration.

There are at present many plastic biological specimen containers in use, particularly those manufactured from polypropylene. Polypropylene has many of the required characteristics such as high resistance to leakage, chemical or biological infiltration, moderate cost, it is resilient yet substantially inert, stable at temperatures of normal use and relatively safely incinerated. However, polypropylene does have a tendency, when elastically deformed at a pressure point such as a seal, to gradually draw back from the pressure point thereby reducing the contact of the seal, resulting in increased susceptibility to leakage. This has led to the search for means for designing a cap for a biological specimen collection container which would have reduced susceptibility to leakage particularly when there is a pressure differential between the inside and outside of the container. One example of such a cap is described in published Canadian Patent Application No. 2,030,609. This cap is designed to provide a rim seal between the closure cap and the peripheral rim portion of a biological specimen collection container. However, it has been found that while such a design does decrease somewhat the susceptibility of the containers to leakage, there is still a significant amount of leakage from such containers.

SUMMARY OF THE INVENTION

The present invention provides for a biological specimen collecting system for holding a biological specimen in a long term sustained sealed environment. The biological specimen collecting system comprises a container for holding the biological specimen and a sealing closure cap. The container is of circular section and has generally vertical sidewalls, the sidewalls at the top terminating in an inwardly sloping sealing surface. The container has a first thread on an exterior surface thereof, the first thread being located below the sealing surface. The sealing closure cap has a peripheral groove to receive the container rim, the peripheral groove being defined by inner and outer walls and a top. The outer wall of the groove is provided with a second thread complementary to the first thread on the container for engagement therewith. The inner wall of the groove is provided with a sealing bead positioned above the second thread, the sealing bead contacting the sealing surface of the container to provide long term sustained sealing of the container by the sealing cap.

In an aspect of the invention there is provided a container for use in a biological specimen collecting system for holding a biological specimen. The container is of circular section and has generally vertical sidewalls, the sidewalls at the top terminating in an inwardly sloping sealing surface. The container has a thread on an exterior surface thereof, the thread being located below the sealing surface.

In another aspect of the invention there is provided a sealing closure cap for use in a biological specimen collecting system. The sealing closure cap has a peripheral groove to receive a container rim, the peripheral groove being defined by inner and outer walls and a top. The outer wall of the groove is provided with a thread for engagement with a container and the inner wall is provided with a sealing bead positioned above the thread for contacting the interior of a sidewall of a container to provide long term sustained sealing of a container by the sealing cap.

BRIEF DESCRIPTION OF THE DRAWINGS

A preferred embodiment of the invention is described in the attached illustrations in which:

FIG. 1 is a perspective view of a biological collection system including a sealing closure cap and a biological specimen container in accordance with the present invention;

FIG. 2 is a side view of the cap and container of FIG. 1;

DETAILED DESCRIPTION OF THE PREFERRED EMBODIMENTS

Figure 3:
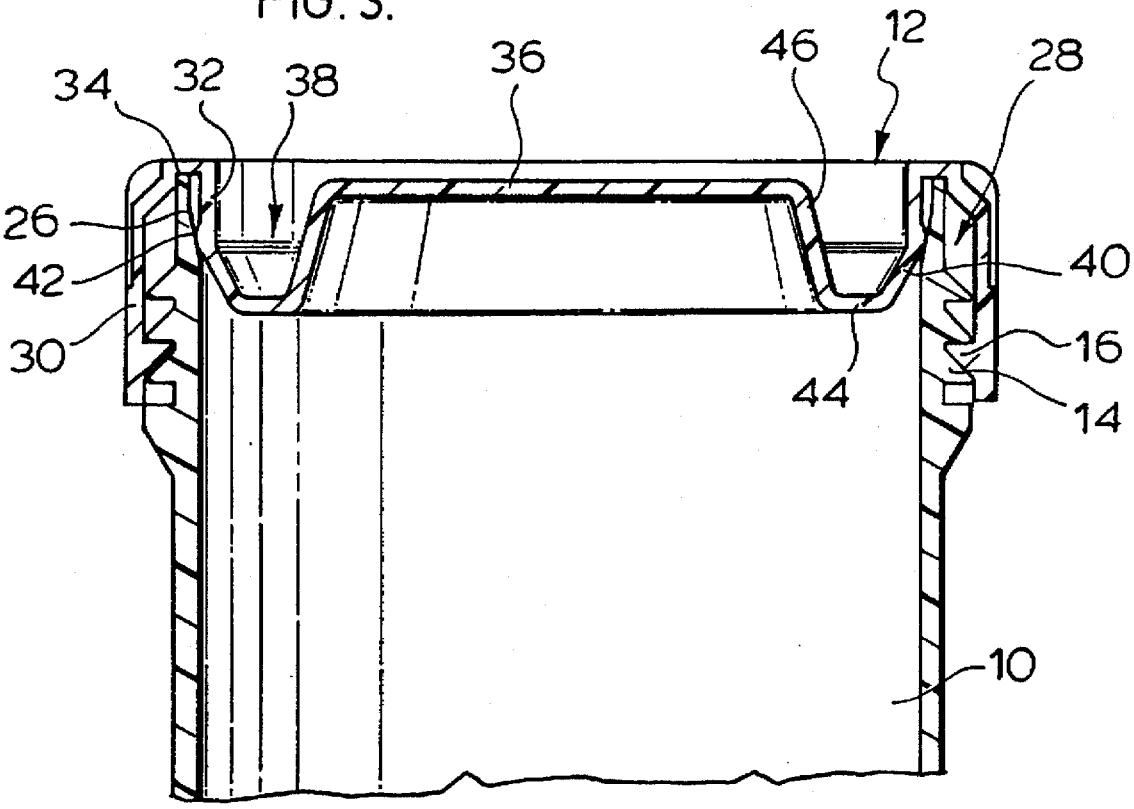
FIG. 3 is a side view in cross-section of the cap and container of FIG. 1.

A preferred embodiment of the biological specimen collection system of the present invention comprising a biological specimen collection container 10 and a sealing closure cap 12 is illustrated in FIGS. 1 and 2. The container 10 and cap 12 are engaged and held in engaged relationship through the use of complementary threads comprising a first thread 14 provided on the exterior of the container 10 and a second thread 16 (not shown in FIGS. 1 and 2) provided on the interior of the cap 12.

The container 10 is circular in section having a vertical side wall 18, a bottom 20 and an open mouth 22 defined by a rim 24. The side wall 18 near the top and above the thread 14 has an inwardly sloping sealing surface 26. If desired, the side wall may then continue vertically above the sealing surface 26 as shown in the illustrated figures.

As shown more clearly in FIG. 3, cap 12 has a peripheral groove 28 to receive the container rim 24, the groove 28 being defined by an outer wall 30, an inner wall 32 and a top 34. The cap 12 also has a crown portion 36 and a connection portion 38 extending between the crown portion 36 and the inner wall 32 of the groove 28. The connection portion 38 includes an annular tapered guidance portion 40. The connection portion 30 also has a bottom 44 connected at one side to the guidance portion 40 and connected at the other side to a tapered wall 46 connected in turn to the crown portion 36. A protuberant annular sealing bead 42 projecting outwardly into the groove 28 is provided on the inner wall 32 preferably at the junction between the guidance portion 40 and the inner wall 32.

Figure 4:
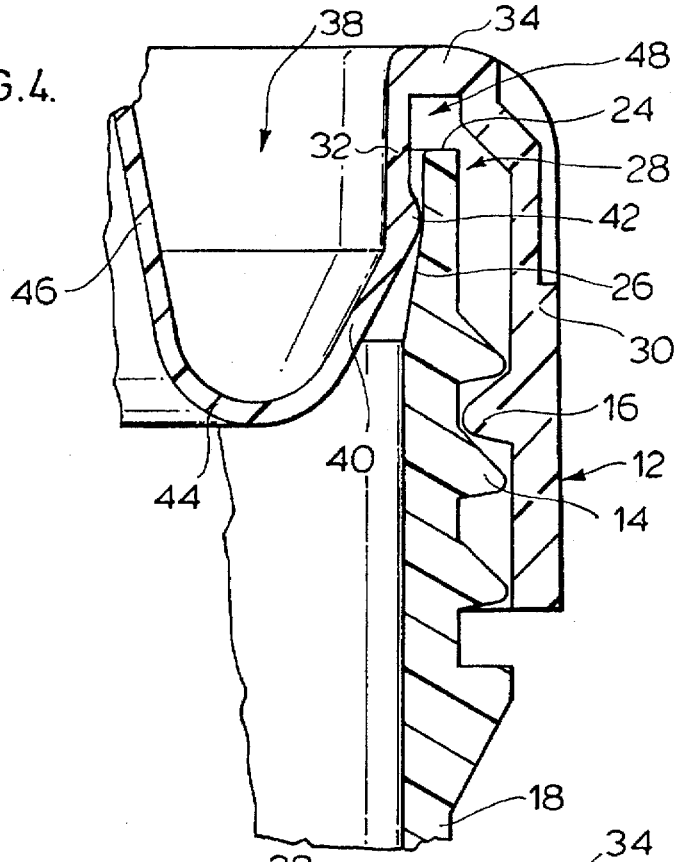
FIG. 4 is a cross-section view of the cap and container of FIG. 1 during the closing of the cap and container.
Figure 5:
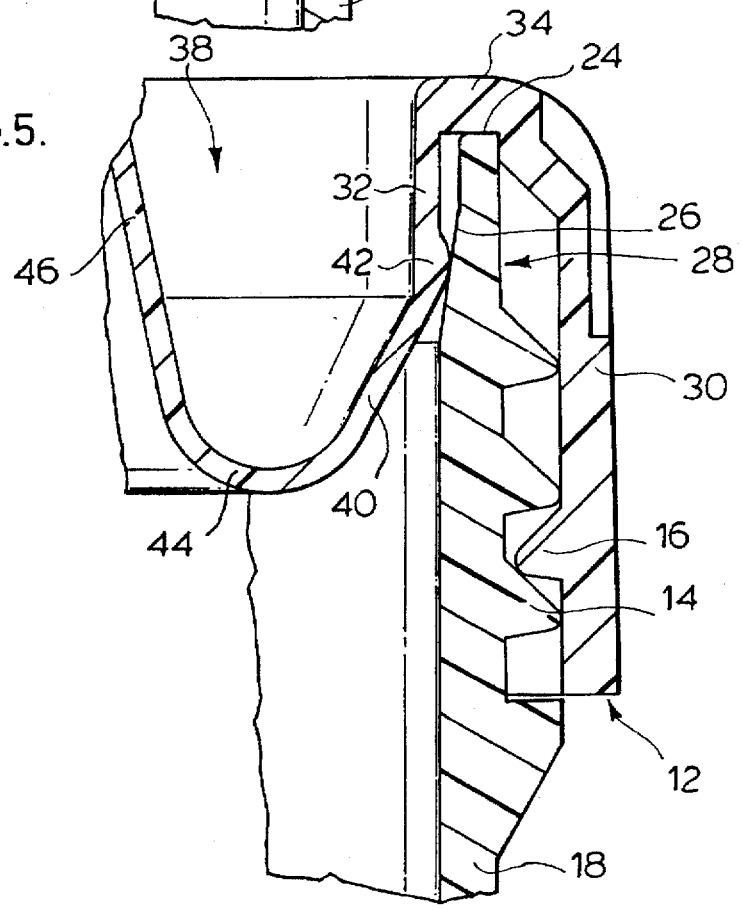
FIG. 5 is a side elevation view in cross-section of the cap and container of FIG. 1 in a closed configuration.

Referring now to FIGS. 4 and 5, the operation of the container 10 and cap 12 during closing will be described. As is shown in FIG. 4, while the cap 12 is being threaded onto the top of the container 10, the shaping of the sealing surface 26 of the container 10 allows for clear passage of the sealing bead 42 into the opening of the container 10. When the cap 12 is fully seated on the container 10 as is shown in FIG. 5, the sealing bead 42 on the inner wall 32 of the groove 28 makes contact with the sealing surface 26 of the side wall 18 of the container 10. If desired, the top of the peripheral groove 28 may be shaped as illustrated in the drawing to provide a pocket 48 for acceptance of the top and outside of the rim 24 of the container 10.

Owing to the design of the container 10 and cap 12 of the present invention, the integrity of the seal between the sealing bead 42 and the sealing surface 26 is maintained under differential pressure. This is accomplished in part through the location of the sealing bead 42 and sealing surface 26 above the threads 14. In molding the container 10 the mass of the threads 14 results in the formation of voids on the interior of the sidewall 18 at the location of the threads 14. By locating the seal above the threads, the integration of the seal is not affected by the voids. Additionally, the shaping of the connection portion 38 which provides resilience to the inner wall 32 to resist deformation of the inner wall 32 and leakage past the sealing bead 42 when a differential pressure is encountered between the exterior and interior container. In preliminary testing, out of some 15,000 such containers tested, not one container has leaked. Additionally, owing to the design, the cap 12 is very easy to seat on the top of the container 10 as it is only during part of the last turn of the cap 12 that the sealing bead 42 comes into actual physical contact with the sealing surface 26 providing resistance to turning. With the design as illustrated, this occurs within the last approximately 12° of turning of the cap.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A biological specimen collecting system for holding a biological specimen in a sustained sealed environment, the biological specimen collecting system comprising:

a container for holding the biological specimen, the container being of circular cross section, the cross section of the container being radially symmetric in each plane which is orthogonal to the center line of the container, the interior surface of the sidewalls of the container sloping downwardly and inwardly from a point at or near the top of said container to a second point, the sidewalls being substantially vertical from the second point downward, the container having an outwardly extending thread region on the exterior surface thereof, and whereby once a cap having a sealing bead is screwed onto the container the entire periphery of the sealing bead engages the sealing surface, and a sealing closure cap mounted on the open end of the container and having a peripheral groove to receive the container rim, the peripheral groove being defined by inner and outer walls and a top, the outer wall of the cap having an inwardly extending thread region complementary to the thread region on the container for engagement therewith, the inner wall of the cap having a sealing bead extending radially outwardly, the entire periphery of the sealing bead contacting the sealing surface of the container to provide sustained sealing of the container by the sealing cap.

* * * * *